United States Patent [19]

Jurschewitz

[11] 4,230,082

[45] Oct. 28, 1980

[54] SYSTEM FOR REGULATING THE FUEL SUPPLY OF AN INTERNAL COMBUSTION ENGINE

[76] Inventor: Paul A. W. Jurschewitz, 43, rue du Poteau, Paris 18e, France

[21] Appl. No.: 32,506

[22] Filed: Apr. 23, 1979

Related U.S. Application Data

[63] Continuation of Ser. No. 709,908, Jul. 29, 1976, abandoned.

[51] Int. Cl.[3] ..... F02M 37/14; F02M 17/10; F02M 19/08

[52] U.S. Cl. ..... 123/518; 123/522; 123/575; 123/579; 261/36 A; 261/70

[58] Field of Search ..... 123/136, 137, 134, 132, 123/139 AV, 119 R, 135; 261/23 A, 70, 72 R, 36 A, 41 C, 41 D, DIG. 50; 137/397, 202

[56] References Cited

U.S. PATENT DOCUMENTS

| | | | |
|---|---|---|---|
| 1,756,781 | 4/1930 | Bergougnoux | 123/134 |
| 2,274,532 | 2/1942 | Dach | 123/119 R |
| 2,598,445 | 5/1952 | Schneider | 123/134 |
| 2,609,187 | 9/1952 | Scott | 123/127 |
| 2,695,029 | 11/1954 | Bruegger | 261/72 R |
| 2,790,630 | 4/1957 | Armstrong | 261/23 A |
| 2,996,290 | 8/1961 | Mundem | 123/127 |
| 2,998,056 | 8/1961 | Capehart | 123/132 |
| 3,006,616 | 10/1961 | Carlson | 261/72 R |
| 3,794,004 | 2/1974 | Stoltman | 261/23 A |
| 3,841,613 | 10/1974 | Eckert | 261/36 A |
| 3,910,302 | 10/1975 | Sudhir | 137/202 |
| 4,007,721 | 2/1977 | Regueiro | 123/134 |

FOREIGN PATENT DOCUMENTS

| | | | |
|---|---|---|---|
| 644866 | 6/1928 | France | 261/36 A |

*Primary Examiner*—Ronald H. Lazarus
*Attorney, Agent, or Firm*—Karl F. Ross

[57] ABSTRACT

A carburetor of an internal-combustion engine in an automotive vehicle has at least one main duct and an ancillary duct supplying an air/fuel mixture to a manifold, the fluid flow through the ducts being controlled by an accelerator via ganged butterfly valves of which the one in the main duct closes completely whereas the one in the ancillary duct closes only partially in an idling position. Separate nozzles deliver fuel to the main duct at a higher hydrostatic head and to the ancillary duct at a lower hydrostatic head, thereby preventing the aspiration of an excessive amount of fuel by the piston cylinders upon deceleration of the vehicle or during idling. The fuel is admitted to the ducts, between a Venturi throat and the butterfly valves, by nozzles fed from a common float-controlled pressure regulator, or from two such pressure regulators, to which the fuel is delivered by gravity from a buffer reservoir also provided with a float valve and connected to the high-pressure side of a fuel pump. In order to avoid unduly lean mixtures in the wide-open position of the butterfly valves, the airstream entering the ancillary duct may be precharged with fuel vapor by being forced to pass through a pool of fuel before reaching that duct. The buffer reservoir has an overflow line leading to the low-pressure side of the pump, directly or via the fuel tank. A check valve, operated by toggle action or by simple flotation, is inserted in the overflow line to prevent reverse surges to the buffer reservoir.

8 Claims, 7 Drawing Figures

FIG. 5
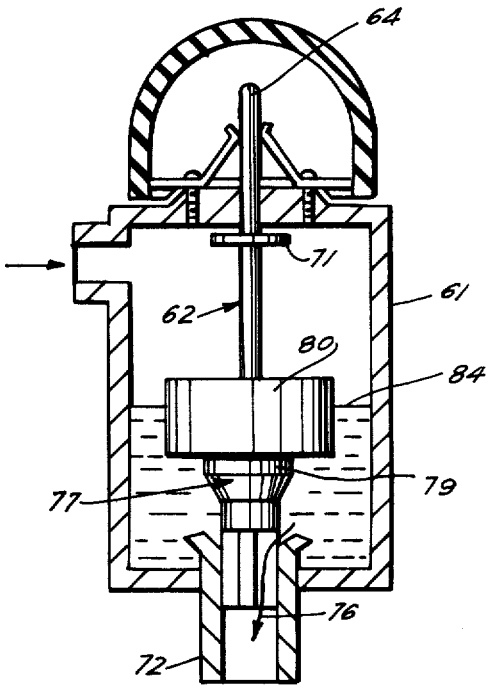
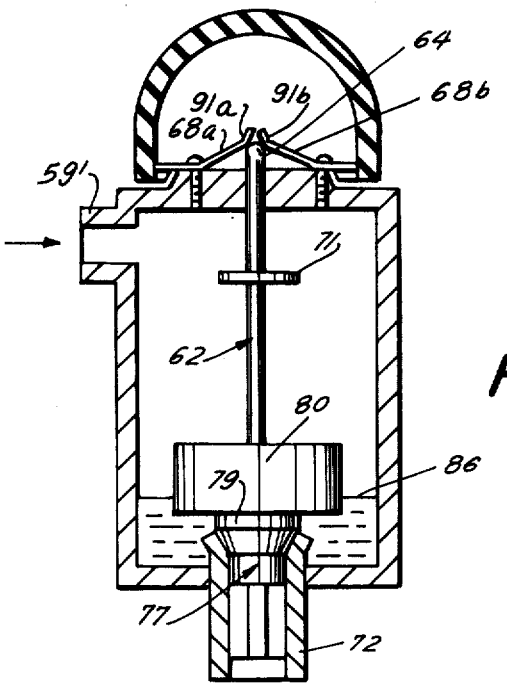
FIG. 6

SYSTEM FOR REGULATING THE FUEL SUPPLY OF AN INTERNAL COMBUSTION ENGINE

This is a continuation of application Ser. No. 709,908, filed July 29, 1976, now abandoned.

FIELD OF THE INVENTION

My present invention relates to a system for regulating the fuel supply of an internal-combustion engine for an automotive vehicle in which a carburetor is fed from an engine-driven fuel pump to deliver an air/fuel mixture to one or more alternately expanding and contracting combustion chambers, i.e. piston cylinders in the case of an engine of the reciprocating-piston type. The invention, however, is also applicable to rotary engines.

BACKGROUND OF THE INVENTION

A large proportion of the pollution of the atmosphere by the exhaust fumes of conventional automotive engines is due to the incomplete combustion of gasoline or other hydrocarbon fuels. In operation, an airstream aspirated through a Venturi throat at the inlet of a duct within the carburetor has a velocity determined, on the one hand, by the setting of an accelerator-controlled butterfly valve in the duct and, on the other hand, by the suction developed in the combustion chamber or chambers. Upon the release of the depressed accelerator pedal by the driver, the duct is progressively throttled by the butterfly valve whereby, for a given engine speed, the flow velocity of the airstream and hence the Venturi effect gradually increase so that relatively more fuel is drawn in. Thus the valve should be so designed that during normal driving, with engine speed varying roughly in proportion to the free cross-section of the duct, the fuel/air ratio in the explosive mixture reaching the cylinders is adapted to the load to insure a reasonably clean combustion. If, however, the engine runs at an above-normal speed with the butterfly valve in a nearly closed limiting position, as when the engine is used for deceleration, the mixture will be too rich so that combustion will be incomplete. A similar situation exists when the engine is idling, the mixture then generally containing too much fuel for the small thrust required. Providing a bypass for additional air is not a satisfactory solution since then the mixture becomes too lean under other driving conditions. Complex and correspondingly expensive systems, including catalytic afterburners, have therefore been devised for the purpose of properly dosing the fuel supply.

Another parameter affecting the air/fuel ratio, to which little attention has been paid heretofore in this context, is the pressure under which the fuel is delivered to the injection nozzle. Unless this pressure is held substantially constant, the supply rate will be subject to variations unrelated to engine speed and accelerator position. A conventional float-controlled pressure regulator, inserted between the engine-driven fuel pump and the carburetor, does not fully solve this problem inasmuch as a spurt in engine speed can still elevate the instantaneous pump pressure to a value overcoming the force with which the needle valve of the regulator is urged into its blocking position by the buoyancy of the float.

OBJECTS OF THE INVENTION

The general object of my present invention, therefore, is to provide an improved pressure-regulating system for the fuel supply of an internal-combustion engine, of the type discussed above, designed to remedy the aforestated drawbacks.

A more particular object is to provide means in such a system for maintaining the air/fuel ratio, under virtually all driving conditions, at or near its optimum value consistent with load so as to insure clean combustion and minimize the pollution of the atmosphere by exhaust fumes.

SUMMARY OF THE INVENTION

According to an important aspect of my invention, a conventional carburetor of the type referred to is modified by providing it with two separate, parallel ducts extending from its constricted throat to a feed channel for the delivery of the air/fuel mixture to the combustion chamber or chambers of the engine, i.e. a main duct and an ancillary duct of smaller cross-section. The two ducts are equipped with separate but ganged butterfly valves designed to be both wide open at full throttle; in the opposite limiting position, i.e. with the accelerator pedal completely retracted, the first butterfly valve blocks the main duct whereas the second butterfly valve keeps the ancillary duct fractionally open for the passage of the air and fuel required for idling. Each duct has its own injection nozzle, upstream of the respective butterfly valve, which receives fuel from the pump under a substantially constant hydrostatic head via a pressure regulator which may be individual to it or common to both nozzles. With the accelerator fully or partly depressed, most of the aspirated air traverses the larger main duct so that the presence of the smaller ancillary duct affects the mode of operation of the carburetor only to a minor extent; thus, as long as the engine works under load, it receives a mixture which grows richer as the two valves approach closure. In the idling position, however, the closing of the main duct shifts the entire supply to the ancillary duct whose butterfly valve allows only a relatively lean mixture to reach the combustion chambers. This changeover from a richer to a leaner mixture at the point of complete retraction of the accelerator can be brought about not only by a suitable dimensioning of the carburetor ducts and choice of the final position of the second butterfly valve but also by a judicious setting of the fuel pressure in the ancillary duct as determined by the hydrostatic head of the fuel reaching its nozzle; thus, this hydrostatic head may be different from (preferably lower than) the hydrostatic head of the fuel entering the nozzle of the main duct.

In a large carburetor the main duct may be subdivided, as is usual, into two (or possibly more) passages each with its own injection nozzle and butterfly valve. In that instance, the ancillary duct is preferably narrower than any of these passages.

Since the principal part of the carburetor is designed to operate in the traditional manner, the ancillary duct can be readily added to an already existing structure with no substantial change other than a repositioning of the main butterfly valve or valves for complete closure in the idling position.

If desired, the airstream entering the ancillary duct may be precharged with fuel vapors by being passed, in a manner known per se, through a vessel provided with a filter overlying a pool of fuel. Since the degree of fuel absorption by the airstream is independent of the Venturi effect at the nozzle orifice, such an arrangement can be used to supplement the directly injected fuel so as to provide substantially the same air:fuel ratio in the two ducts in any working position while avoiding excessive enrichment of the mixture in the idling position.

Pursuant to another important aspect of my invention, the pressure regulator is provided with a buffer reservoir above a float-controlled level stabilizer, this buffer reservoir communicating via another float valve with the fuel pump and having a discharge line through which fuel is delivered from its fluid store to the level stabilizer exclusively by gravity. Thus, while the fluid level in the buffer reservoir may vary irregularly in the event of sudden accelerations of the engine, these variations reach the needle valve of the level stabilizer only in greatly attenuated form and will not affect its normal operation. In order to prevent excessive fuel accumulations in the buffer reservoir, the latter should be provided with an overflow line extending to an intake of the fuel pump, either directly or via the fuel tank. Preferably, according to another feature of my invention, that overflow line is equipped with a check valve blocking the return of fuel to the buffer reservoir by reverse surges, e.g. on backing if that line extends rearwardly from the hood to the tank and has one or more low points in which fuel can accumulate.

Although the use of a buffer reservoir with gravity feed is particularly advantageous in combination with my improved carburetor as described above, such a combination being highly effective in maximizing fuel economy and minimizing pollution, it should be understood that a fuel-pressure regulator incorporating such a reservoir will have utility also in conjunction with conventional carburetors.

BRIEF DESCRIPTION OF THE DRAWING

The above and other features of my invention will now be described in detail with reference to the accompanying drawing in which:

FIGS. 4, 5 and 6 are cross-sectional views of a modified check valve in three different positions.

SPECIFIC DESCRIPTION

Figure 1:
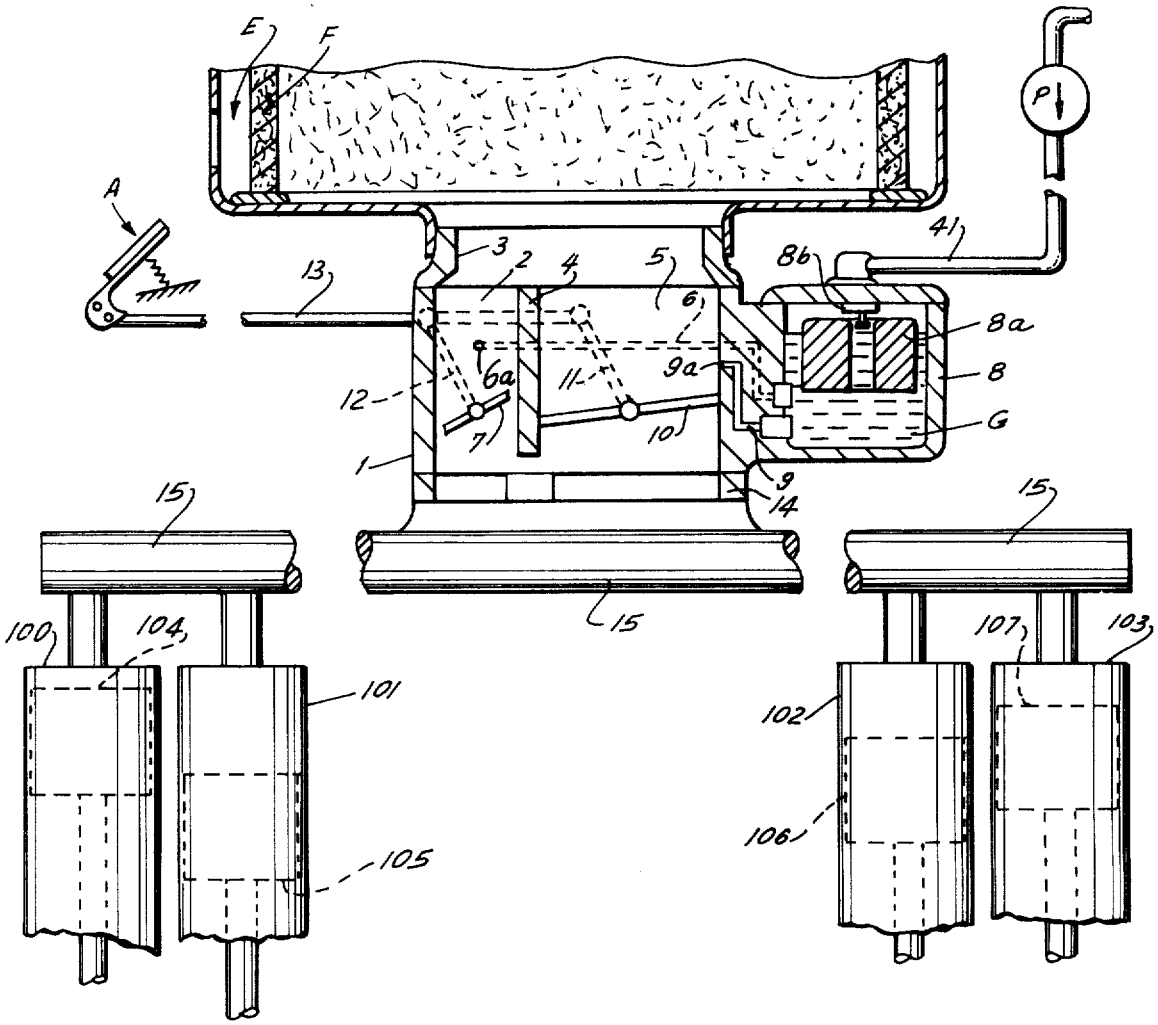
FIG. 1 is a somewhat diagrammatic cross-sectional view of a carburetor forming part of a fuel-supply system embodying my invention.

As seen in FIG. 1, an internal-combustion engine of an otherwise nonillustrated automotive vehicle has a carburetor 1 connected by a heat-dissipating flange 14 to an intake manifold 15. The manifold 15 feeds the fuel/air mixture produced in the carburetor 1 to four cylinders 100, 101, 102, 103, whose pistons 104, 105, 106, 107 are driven in the well-known manner by explosive combustion of the mixture. Atmospheric air aspirated during the suction strokes of the pistons enters a filter F through one or more apertures E of the carburetor housing and proceeds through a Venturi throat 3 to an ancillary duct 2 and a larger main duct 5 separated by a partition 4. Fuel is introduced into the ancillary duct 2 by a nozzle 6*a* at a lower hydrostatic head than that delivered to the main duct 5 by another nozzle 9*a*. The nozzles 6*a*, 9*a* are connected by respective fuel lines 6, 9 to a pressure regulator 8. A float 8*a* in the bowl of that regulator controls the level of fuel G through a needle valve 8*b*. Fuel is supplied to the regulator 8 by a pipe 41 from an engine-driven fuel pump P. A butterfly valve 7 in the ancillary duct 2 and a butterfly valve 10 in the main duct 5 are connected through respective links 12, 11 to a control rod 13 and thereby to an accelerator pedal A.

When the pedal A is retracted, the valve 10 in the main duct 5 is shut and the valve 7 in the ancillary duct 2 is partly open, as shown. Thus, during idling or deceleration, the manifold 15 receives its fuel and air supply only from duct 2 at a rate determined by the throttling position of valve 7.

Figure 2:
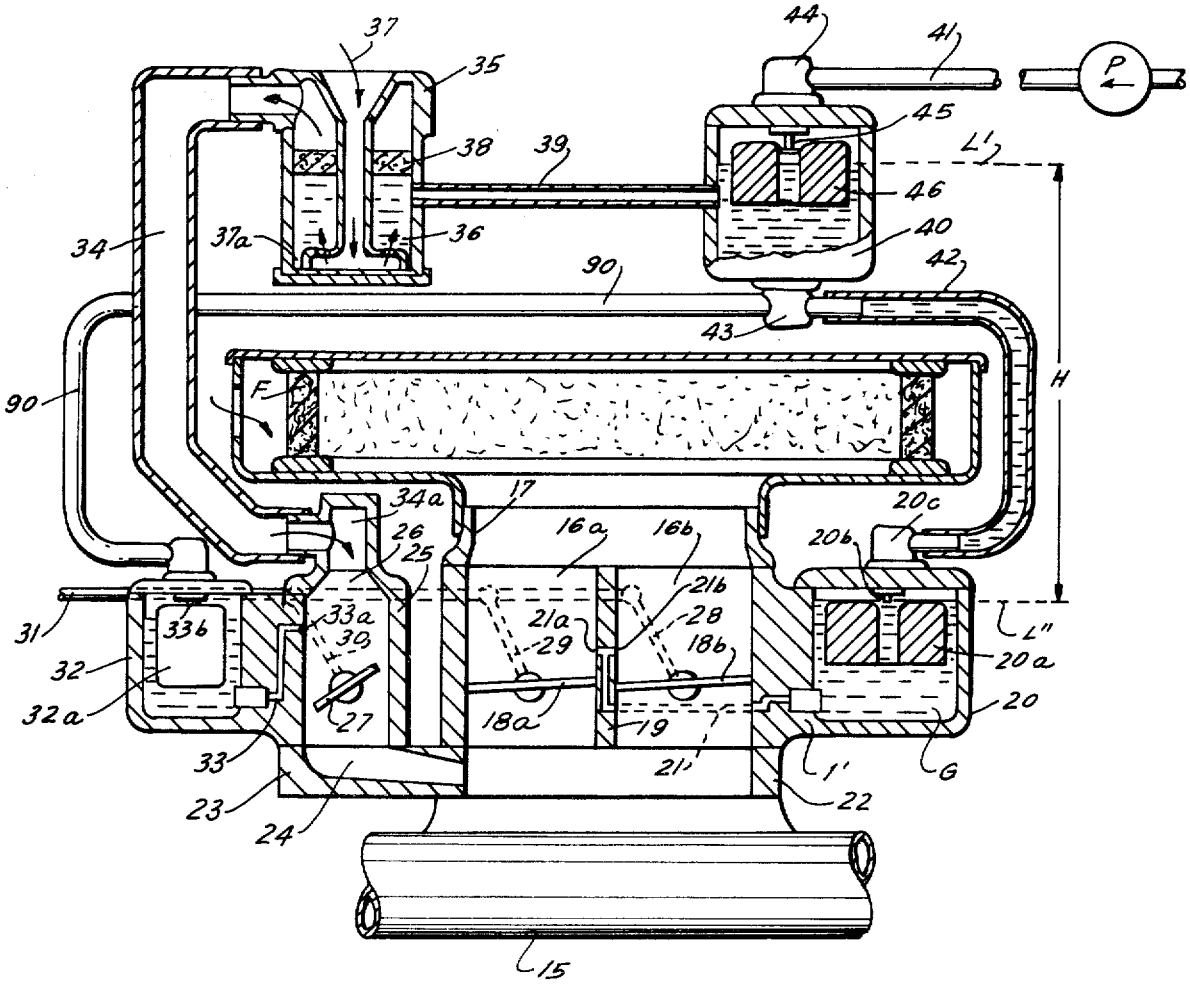
FIG. 2 is a view similar to FIG. 1, showing another type of carburetor in combination with a buffer reservoir forming part of a modified system according to my invention.

In FIG. 2 a carburetor 1' disposed below the hood of a vehicle has a duct divided by a partition 19 into two parallel passages 16*a*, 16*b* with a common Venturi throat 17 at their inlet. These passages are equipped with respective butterfly valves 18*a*, 18*b* and nozzles 21*a*, 21*b* communicating with a level stabilizer 20 of a pressure regulator through a fuel line 21. Fuel G in the bowl of stabilizer 20 is kept at a constant level by a float 20*a* operating a needle valve 20*b*. The stabilizer 20 is supplied with fuel through its entrance port 20*c* by a gravity-feed line 42 extending from a discharge port 43 of a buffer reservoir 40 also mounted beneath the hood. A float 46 operates a needle valve 45 controlling the amount of fuel allowed to pass from pump P through a conduit 41 and an entrance port 44 into the reservoir 40. The liquid level L' in the reservoir lies at a height H above the liquid level L'' in the stabilizer 20. Fuel surges from the pump P, forcing open the float valve 45, are transmitted only in greatly attenuated form through the line 42 to the stabilizer 20.

An ancillary duct 26 is formed alongside the main duct 26*a*, 26*b* of carburetor 1' by an attachment 25 mounted on an extension 23 of a heat-dissipating flange 22. A channel 24 underneath a butterfly valve 27 joins the ancillary duct 26 to the passages 16*a*, 16*b* below the butterfly valves 18*a*, 18*b*. Another level stabilizer 32, of smaller capacity than stabilizer 20, supplies fuel through a line 33 to a nozzle 33*a* in the ancillary duct 26, at a constant hydrostatic head lower than that prevaling at the orifices of nozzles 21*a*, 21*b* in the main duct 16*a*, 16*b*. The amount of fuel entering the level stabilizer 32 through a fuel line 90 from the buffer reservoir 40 is controlled by a float 32*a* which operates a needle valve 32*b*.

The ancillary duct 26 has its own air-intake tube 34 terminating at a Venturi throat 34*a*. Atmospheric air is aspirated through tube 34 in series with an enricher comprising a closed vessel 35, the air entering that vessel through a funnel 37 which broadens at the bottom of a pool of fuel 36 into an apertured base 37*a* whence the air bubbles upwardly and escapes via a filter 38 into the tube 34. Vessel 35 communicates by way of a conduit 39 with the buffer reservoir 40. The enricher charges the air with fuel vapors before it reaches the ancillary duct 26 to guard against an unduly lean fuel/air mixture which might otherwise be produced under high load when the valve 27 is wide open so that the ancillary duct 26 contributes significantly to the flow reaching the manifold 15. The butterfly valve 27 in the ancillary duct 26 is ganged with the butterfly valves 18*a*, 18*b* in the main duct by a common control rod 31 engaging these valves through respective links 30, 29, 28.

Figure 3:
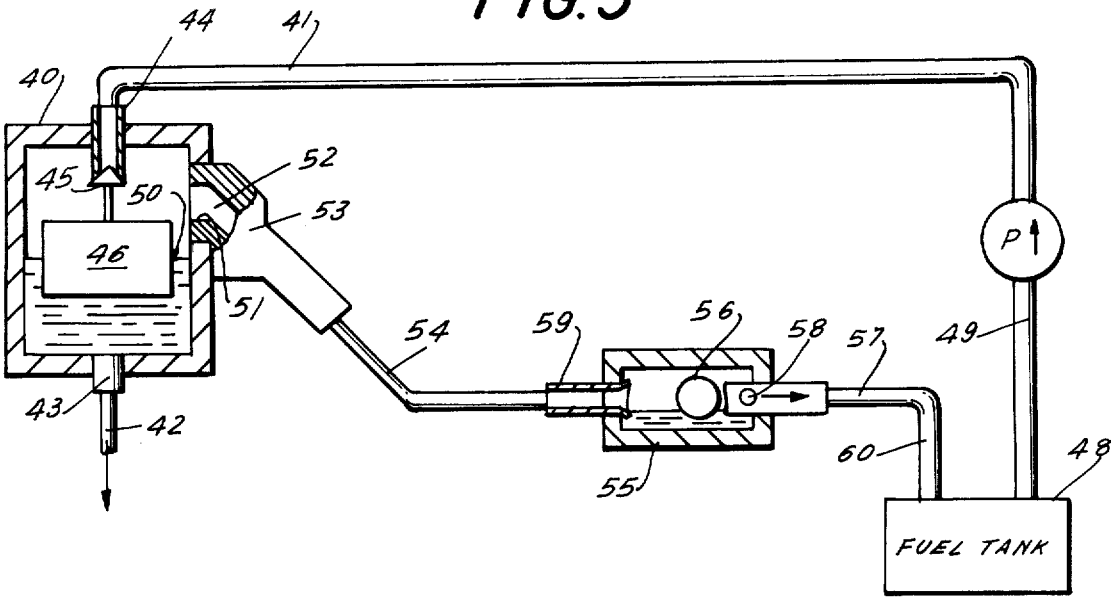
FIG. 3 is a diagrammatic view, partly in section, of an overflow circuit—including a check valve—for the buffer reservoir of FIG. 2.

FIG. 3 shows the buffer reservoir 40 provided with an overflow collector 53. If the fuel level 50 rises above an edge 51, an outlet 52 carries the excess fuel to a line 54 leading from the collector 53 to a tank 48 from which a conduit 49 extends to the low-pressure side of pump P. A check valve 55 in line 54 comprises an elongate cylindrical body parallel to the axis of the vehicle. The overflowing fuel runs through a pipe 60 into the tank 48 but cannot be returned to the line 54 by reverse surges. An inlet port 59 of check valve 55 forms a seat for a ball 56, of substantially the same density as the fuel, when the ball is swept back to port 59 by the surging liquid; during normal flow (from left to right), ball 56 comes to rest against an outlet port 57 which has perforations 58 so as never to be blocked by the ball.

Figure 4:
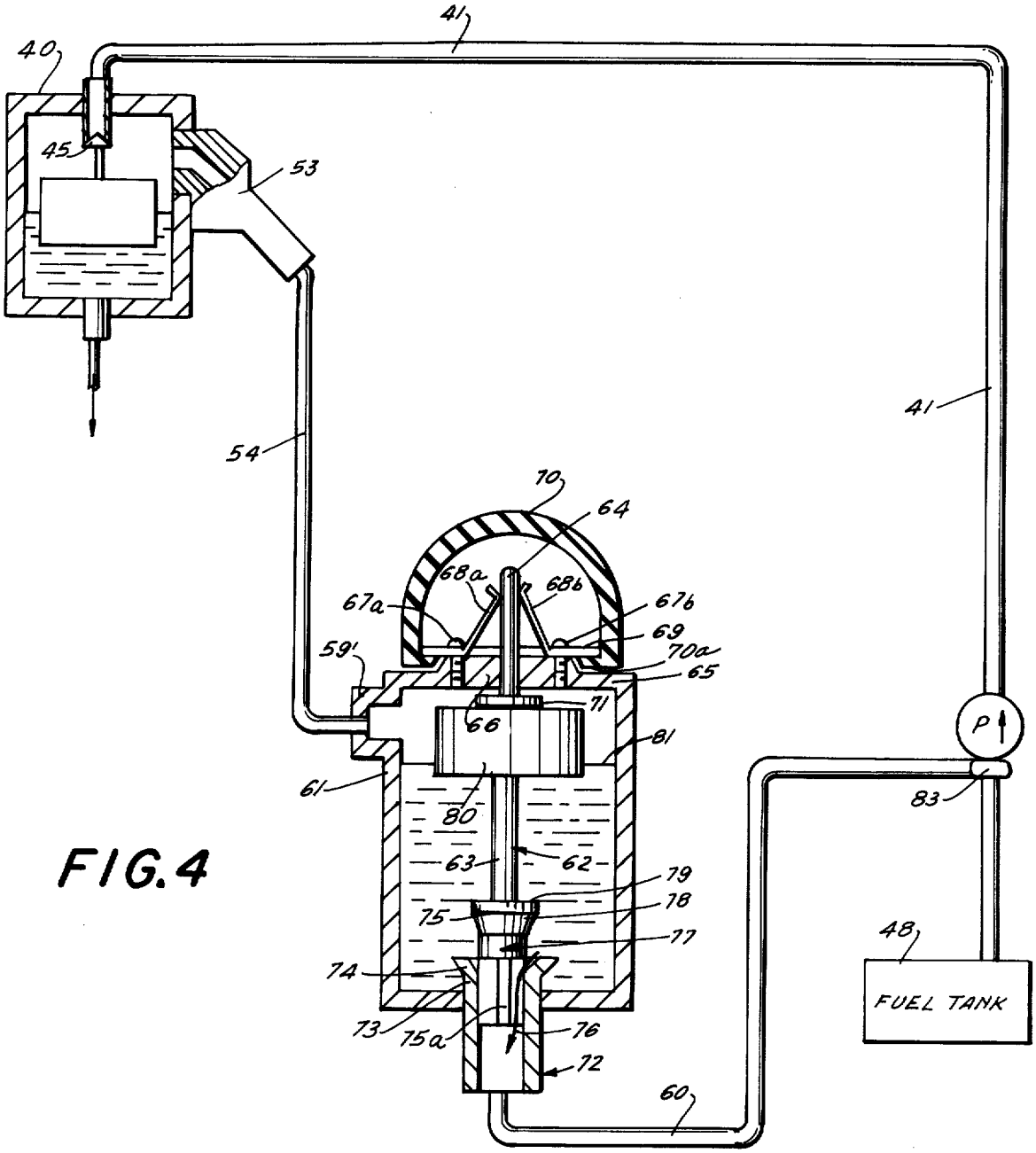

In FIGS. 4–6 I have shown an alternate check valve 61 designed for the case where the conduit 54 extends substantially vertically down from buffer reservoir 40. A toggle member or plunger 62 in the upright housing of valve 61 has a stem 63 carrying two stops 71 and 79. A float 80 is freely traversed by the stem 63 between these stops. An upper extremity 64 of the plunger 62 passes through a boss 66 on a cover 65 of the valve housing between two leaf springs **68*a*, 68*b* that are integral with a semiannular plate 69 centered on the housing axis, the plate 69 being fastened to the boss 66 by screws 67*a*, 67*b*. An elastic dome 70 engages the plate 69 with a flange 70*a* and protects the leaf springs 68*a*, 68*b*. The stop 79 forms the upper end of a plug 77 which comprises a tapering head 78 and a cylindrical neck 75 with a cross-shaped profile at its lower end 75*a*. The plug 77 mates with a cylindrical sleeve 73 and a tapered collar 74 of a drain 72**.

A high fuel level 81 lifts the float 80 against the stop 71, as shown in FIG. 4. Fuel admitted to the valve 61 through its inlet port 59' flows out through the fluted end **75*a* of the plug 77 along a path 76 into return pipe 60 which in this instance terminates at the low-pressure side 83** of the pump P to complete a closed circuit.

In FIG. 5 a drop in fuel to an intermediate level 84 has brought the float 80 to a lower position remote from stop 71 and in contact with stop 79. Owing to the lost-motion coupling between the float and the plunger, the latter is retained in the limiting position of FIG. 4 since its end 64 is still frictionally gripped by the leaf springs **68*a*, 68*b*, most of the weight of the float 80 remaining supported by the body of liquid fuel which continues to flow out of the open drain 72**.

FIG. 6 shows a level of fuel 86 below the point where it supports the float 80. The float now bears upon the stop 79 with enough of its weight to let the plunger end 64 descend below the knees **91*a*, 91*b* of the leaf springs 68*a*, 68*b* which thereupon approach each other above the plunger 62 to exert on it a downward thrust holding the plug 77 firmly in the drain 72, thereby effecting a tight seal against reverse surges. The toggle action of springs 68*a*, 68*b*** now maintains this limiting plunger position as long as the fluctuations in fluid level remains within a predetermined range.

The plunger 62 will reopen the drain 72 only after enough fuel has entered the valve 61 through the inlet port 59' to carry the float 80 back to a position abutting the stop 71 with a buoyancy overcoming the force of the leaf springs **68*a*, 68*b* to allow the float 80 to return to the unblocking position of FIG. 4**.

Figure 7:
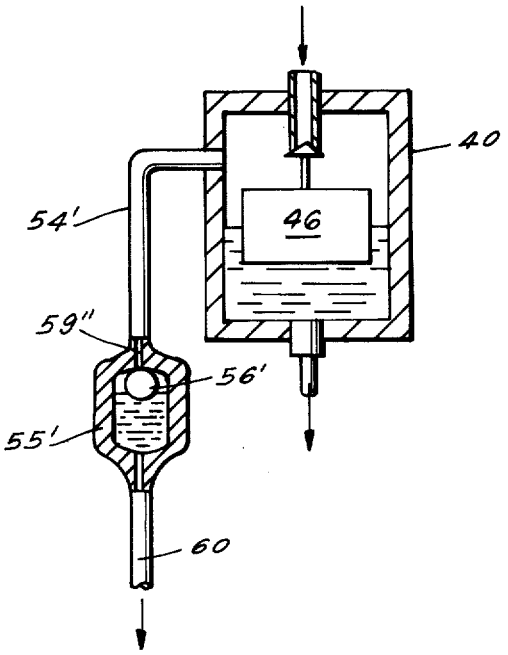
FIG. 7 is a cross-sectional view of a further check valve adapted to be used in the circuit of FIG. 3.

FIG. 7 shows an upright check valve 55' connected to an elbow-shaped overflow tube 54' threaded into the wall of buffer reservoir 40. A floating sphere 56' seals an inlet port 59'' of the check valve 55' when the fuel reaches a predetermined height. The specific weight of sphere or ball 56' must be less than that of the fuel, in contrast to that of ball 56 (FIG. 3) which could be a little higher.

I claim:

1. In an internal-combustion engine for an automotive vehicle, provided with a carburetor fed from a fuel pump by way of interposed pressure-regulating means for supplying a fuel/air mixture under the control of an accelerator to an alternately expanding and contracting combustion chamber, the improvement wherein said carburetor comprises:

a main duct provided with a constricted throat forming a first air inlet and with a first outlet leading to said combustion chamber;

an ancillary duct of smaller cross-section than said main duct provided with a constricted throat forming a second air inlet and with a second outlet leading to said combustion chamber;

at least one first butterfly valve in said main duct linked with said accelerator for displacement between a wide-open position and a fully closed position;

a second butterfly valve in said ancillary duct ganged with said first butterfly valve for displacement by said accelerator between a wide-open position coinciding with the wide-open position of said first butterfly valve and a throttling position coinciding with said fully closed position;

a first injection nozzle opening into said main duct between said first inlet and said first butterfly valve and communicating with said pressure-regulating means for receiving fuel therefrom;

a second injection nozzle opening into said ancillary duct between said second inlet and said second butterfly valve and communicating with said pressure-regulating means for receiving fuel therefrom, said first and second injection nozzles communicating with said pressure-regulating means by way of respective connections supplying fuel thereto at a higher and a lower hydrostatic head, respectively;

a vessel containing a pool of fuel, said second air inlet communicating with the atmosphere through said vessel whereby air aspirated through said ancillary duct is precharged with fuel vapors; and an air filter in said vessel overlying said pool, said vessel having an air entrance opening into said pool and an air exit above said filter whereby the aspirated air passes through said filter after traversing said pool.

2. In an internal-combustion engine for an automotive vehicle, provided with a carburetor fed from a fuel pump by way of interposed pressure-regulating means for supplying a fuel/air mixture under the control of an accelerator to an alternately expanding and contracting combustion chamber, the improvement wherein said carburetor comprises:

a main duct provided with a constricted throat forming a first air inlet and with a first outlet leading to said combustion chamber;

an ancillary duct of smaller cross-section than said main duct provided with a constricted throat forming a second air inlet and with a second outlet leading to said combustion chamber;

at least one first butterfly valve in said main duct linked with said accelerator for displacement between a wide-open position and a fully closed position;

a second butterfly valve in said ancillary duct ganged with said first butterfly valve for displacement by said accelerator between a wide-open position coinciding with the wide-open position of said first butterfly valve and a throttling position coinciding with said fully closed position;

a first injection nozzle opening into said main duct between said first inlet and said first butterfly valve and communicating with said pressure-regulating means for receiving fuel therefrom;

a second injection nozzle opening into said ancillary duct between said second inlet and said second butterfly valve and communicating with said pressure-regulating means for receiving fuel therefrom, said pressure-regulating means including a level stabilizer and a buffer reservoir above said level stabilizer, said buffer reservoir and said level stabilizer being each provided with a float valve, said buffer reservoir communicating with said fuel pump and being provided with a discharge line extending to said level stabilizer for feeding fuel thereto exclusively by gravity, said buffer reservoir being further provided with an overflow line for returning excess fuel to an intake of said fuel pump;

a check valve in said overflow line for preventing the return of fuel to said buffer reservoir by reverse surges, said check valve having an upright housing with an inlet port near its top connected to said buffer reservoir and an outlet port near its bottom connected to said intake;

a plug vertically slidable between a lower limiting position blocking said outlet port and an upper limiting position unblocking said outlet port;

float means in said housing elevatable by a rising accumulation of fuel therein;

abutment means on said plug engageable by said float means with lost motion for entraining said plug into said lower limiting position upon a lowering of the fuel accumulation below a predetermined first level and entraining said plug into said upper limiting position upon a rising of the fuel accumulation above a predetermined second level; and retaining means effective upon disengagement of said float means from said abutment means for holding said plug in the limiting position last reached.

3. The improvement defined in claim 2 wherein said plug is provided with a stem carrying said abutment means, said retaining means comprising a pair of opposite leaf springs engaging an upper extremity of said stem and coming to rest on said extremity in said lower limiting position of said plug.

4. In an internal-combustion engine for an automotive vehicle, provided with a carburetor fed from a fuel pump by way of pressure-regulating means for supplying a fuel/air mixture under the control of an accelerator to an alternately expanding and contracting combustion chamber, the improvement wherein said pressure-regulating means comprises:

a level stabilizer including a bowl provided with first float means;

a buffer reservoir provided with second float means and located above said bowl, said buffer reservoir communicating with said fuel pump;

a discharge line extending from said buffer reservoir to said bowl for feeding fuel thereto exclusively by gravity, said buffer reservoir being provided with an overflow line for returning excess fuel to an intake of said fuel pump;

a check valve in said overflow line for preventing the return of fuel to said buffer reservoir by reverse surges, said check valve having an upright housing with an inlet port near its top connected to said buffer reservoir and an outlet port near its bottom connected to said intake;

a plug vertically slidable between a lower limiting position blocking said outlet port and an upper limiting position unblocking said outlet port;

float means in said housing elevatable by a rising accumulation of fuel therein;

abutment means on said plug engageable by said float means with lost motion for entraining said plug into said lower limiting position upon a lowering of the fuel accumulation below a predetermined first level and entraining said plug into said upper limiting position upon a rising of the fuel accumulation above a predetermined second level; and retaining means effective upon disengagement of said float means from said abutment means for holding said plug in the limiting position last reached.

5. The improvement defined in claim 4 wherein said plug is provided with a stem carrying said abutment means, said retaining means comprising a pair of opposite leaf springs engaging an upper extremity of said stem and coming to rest on said extremity in said lower limiting position of said plug.

6. In an internal-combustion engine for an automotive vehicle, provided with a carburetor fed from a fuel pump by way of pressure-regulating means for supplying a fuel/air mixture under the control of an accelerator to an alternately expanding and contracting combustion chamber, the improvement wherein said pressure-regulating means comprises:

a buffer reservoir provided with float means and communicating with said fuel pump;

a discharge line extending from said buffer reservoir to said carburetor for feeding fuel thereto, said buffer reservoir being provided with an elevated outlet and an overflow line extending from said outlet for returning excess fuel to an intake of said pump; and a check valve in said overflow line below the level of said outlet for preventing the return of fuel to said buffer reservoir by reverse surges, said check valve having an elongate housing which extends generally horizontally in the direction of travel of the vehicle and is provided with an inlet port and an outlet port at opposite ends and with a valve body freely movable in said housing between said inlet and outlet ports for entrainment by surging fuel toward said inlet port while being normally spaced from the latter, said inlet port being connected to said buffer reservoir, said outlet port being non-blockable by said valve body and leading to a fuel tank communicating with said intake.

7. The improvement defined in claim 6 wherein said valve body is a ball.

8. The improvement defined in claim 6 or 25 wherein said pressure-regulating means further comprises a level stabilizer including a bowl with a float-stabilized liquid level, said buffer reservoir being located above said bowl for feeding fuel thereto via said discharge line exclusively by gravity.

* * * * *